US005584260A

United States Patent [19]

Hemphill

[11] Patent Number: 5,584,260

[45] Date of Patent: Dec. 17, 1996

[54] TUBE ATTACHMENT DEVICE FOR INFLATABLE BOATS

[75] Inventor: Douglas Hemphill, Richmond, Canada

[73] Assignee: Zodiac Hurricane Technologies, Inc., Richmond, Canada

[21] Appl. No.: 526,681

[22] Filed: Sep. 11, 1995

[51] Int. Cl.[6] ..... B63B 7/08

[52] U.S. Cl. ..... 114/345

[58] Field of Search ..... 114/345; 441/40

[56] References Cited

U.S. PATENT DOCUMENTS

| | | | |
|---|---|---|---|
| 4,329,751 | 5/1982 | Cigognetti | 114/345 |
| 4,498,413 | 2/1985 | Cochran | 114/345 |
| 4,628,854 | 12/1986 | Harding | 114/345 |
| 4,934,301 | 6/1990 | Harding | 114/345 |
| 4,976,213 | 12/1990 | Smith | 114/345 |
| 5,184,564 | 2/1993 | Robbins et al. | 114/345 |

FOREIGN PATENT DOCUMENTS

| | | | |
|---|---|---|---|
| 3507353 | 9/1986 | Germany | 114/345 |
| 63991 | 3/1990 | Japan | 114/345 |

*Primary Examiner*—Sherman Basinger
*Attorney, Agent, or Firm*—Larson & Taylor

[57] ABSTRACT

A device for joining an inflatable tube to the hull and deck of an inflatable boat. The device includes an outwardly extending deck flange having a trough therein and an outwardly extending hull flange positioned adjacent to the deck flange. The inflatable tube is provided with a tube connector member which is adapted to fit into the trough in the deck flange. An attachment member engages the outward edges of the deck flange and hull flange and includes an attachment flange adapted to extend over a portion of the trough to create a channel in which the tube connector element is received whereby the tube connector element is retained in the trough.

20 Claims, 4 Drawing Sheets

TUBE ATTACHMENT DEVICE FOR INFLATABLE BOATS

FIELD OF THE INVENTION

The present invention relates to a device for attaching inflatable tubes to the rigid hull and deck of a boat.

BACKGROUND OF THE INVENTION

The boats to which this invention is applicable are commonly known as rigid-hull inflatable boats. These boats are characterized by an inflatable tube which extends around at least a portion of the perimeter of the boat to form the sidewall thereof. Many methods of attaching the tube to the hull and/or deck are known. Some methods provide a removable attachment while others are permanent. Removable attachments are preferred since they permit repair and replacement of the tube without the need for a major overhaul of the boat.

One type of removable attachment is disclosed in U.S. Pat. No. 4,329,751 (Cigognetti) where the inflatable tube is provided with a reinforced panel through which screws are threaded. These screws are screwed into the hull or deck of the boat in order to attach the inflatable tube to the boat. The attachment means also employs an arcuate strap which serves to keep the screws from loosening during use of the boat.

U.S. Pat. No. 4,934,301 (Harding) discloses a means for attaching tubes to inflatable boats. The tube is secured to the hull of a rigid inflatable boat by a rigid plate which is retained at the outside of the tube by means of a pocket fastened to the tube. A screw is anchored in the rigid plate and secured to a flange of the hull to thereby fasten the tube to the hull.

U.S. Pat. No. 4,628,854 (Harding) also discloses a means of securing inflatable tubes to rigid hulls. An edge portion of the hull is clamped between flexible flanges which are secured to the inflatable tube using comparatively rigid clamping strips. The clamping strips are pressed together by a releasable securing arrangement passing through the gunwale of the hull such as nuts and bolts spaced along the strips. Tightenable straps anchored by the bolts may be added for extra security.

U.S. Pat. No. 4,976,213 (Smith) also discloses a means for securing tubes to inflatable boats. Smith discloses a securing means which employs toggle stop means such as a three-bar buckle borne on flexible tags attached to the tube. The toggle stop means is rotatable so as to be passable through apertures in the hull and to engage the hull and prevent such passage. Inflation of the tube causes positive urging of the stop means toward such engagement.

Finally, U.S. Pat. No. 4,498,413 (Cochran) also discloses a releasable attachment means for attaching inflatable bladders to the hull of a boat. The hull includes apertures through which a portion of the inflatable bladder is passed when in the deflated condition. Upon inflation of the bladder, the portion which passed through the aperture in the hull also inflates to thereby secure the bladder to the hull. The bladders may also be provided with interlocking end structures to stabilize the positions of the bladders with respect to each other and the hull.

All of the foregoing securing means are difficult to employ and some of them require additional stabilizing structures and/or a large number of screws or other fastening means in order to attach the inflatable tube to the deck of a boat. Accordingly, there is a need in the art for a simplified means for joining the inflatable tube to the hull and/or deck of the boat such that it can be easily removed for repair or replacement. Further, there is a need in the art for a means which provides an easy method for removing the inflatable tube such that the repair or replacement operation can be accomplished in a short time without special tools or difficult manipulations.

These and other objects of the present invention will be described in the summary in detailed descriptions which follow.

SUMMARY OF THE INVENTION

The present invention relates to a device for joining an inflatable tube to the hull and deck of a rigid boat. In particular, the boat is provided with an outwardly extending flange attached to the deck and having a trough spaced inwardly from the outboard edge of the flange. An outwardly extending hull flange attached to the hull of the boat is positioned adjacent the deck flange and a tube connector element attached to the inflatable tube of the boat is placed in the trough in the deck flange. Finally, an attachment member engages the outboard edges of the deck flange and hull flange and includes an attachment flange adapted to extend over a portion of the trough to retain the tube connector member in the trough of the deck flange.

In a second aspect, the present invention relates to an inflatable boat including a deck, a hull and at least one inflatable tube extending around at least a portion of the perimeter of the boat to form a sidewall. An outwardly extending deck flange attached to the deck of the boat is provided with a trough spaced inwardly from the outward edge thereof. The hull of the boat also includes an outwardly extending hull flange attached to the hull and positioned adjacent the deck flange. The inflatable tube is provided with a tube connector member attached to the inflatable tube and adapted to fit into the trough of the deck flange. Finally, an attachment member is provided which engages the outboard edges of the deck flange and the hull flange and includes an attachment flange which is adapted to extend over a portion of the trough in the deck flange to retain the tube flange in the trough.

Finally, the present invention also relates to a method of attaching an inflatable tube to the deck and hull of a rigid boat which is provided with the attachment device of the invention as described above. In the method, the tube connector member is inserted in the trough of the deck flange with the inflatable tube positioned on the deck of the boat in at least partially deflated condition. Then, at least a section of the attachment member is positioned in engagement with the outboard edges of the deck and hull flanges such that the attachment flange extends over the trough in the deck flange. Finally, the inflatable tube is inflated to a fully inflated condition. In this manner, the inflatable tube is secured to the deck and hull of the boat.

The present invention provides a simple and effective means for securing an inflatable tube to a rigid boat whereby the inflatable tube is easily removable for repair or replacement. Further, the attachment device provides structural support to the hull/deck joint of the boat thereby providing additional rigidity to the boat infrastructure. These aspects of the present invention provide an improvement over known removable attachment apparatus for inflatable tubes.

DETAILED DESCRIPTION OF THE PREFERRED EMBODIMENTS

In the following description, like numerals represent like elements throughout the several views.

Figure 1:
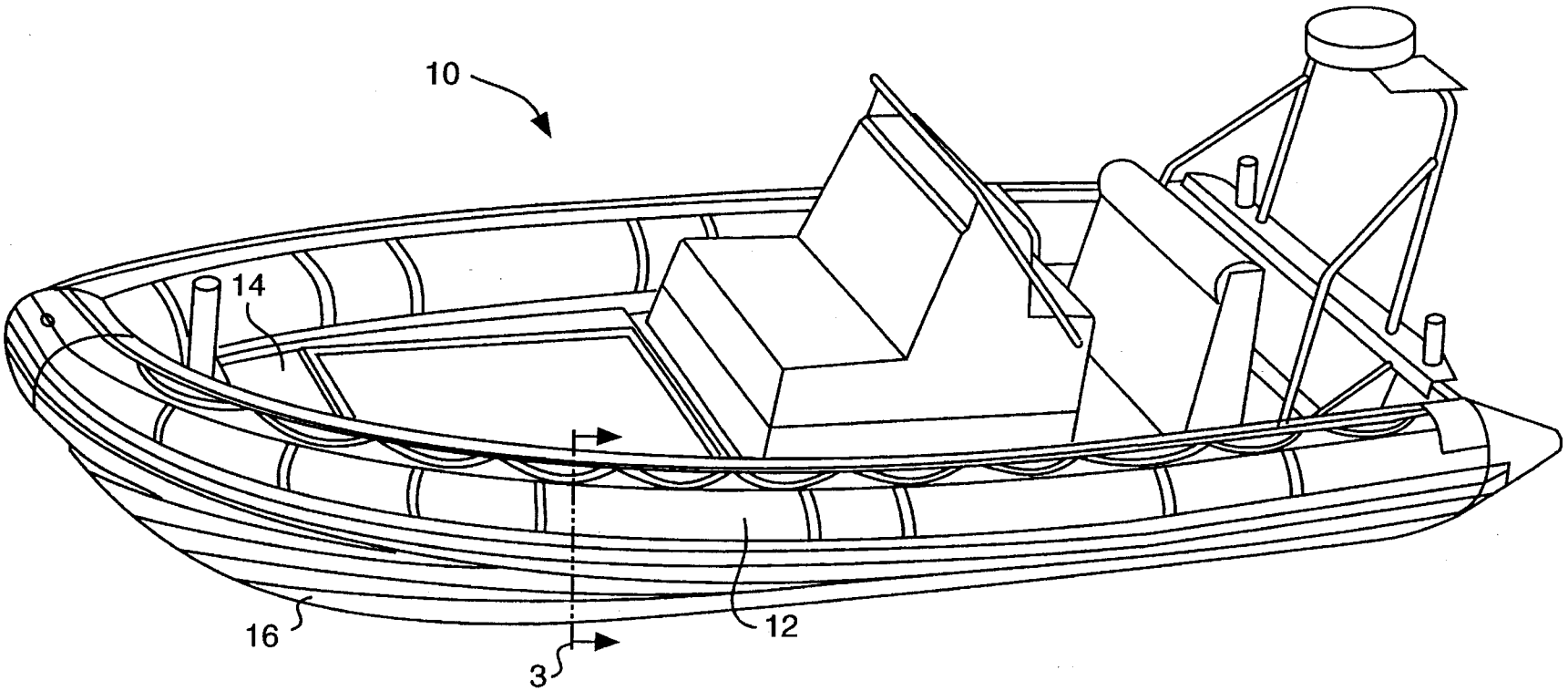
FIG. 1 is a perspective view of an inflatable boat incorporating a tube attachment device in accordance with the present invention.

Referring to FIG. 1, there is shown an inflatable boat 10 which includes at least one inflatable tube element 12 extending around at least a portion of the perimeter of inflatable boat 10. Inflatable tube element 12 is attached to deck 14 and hull 16 of the boat 10. Apart from the inflatable tube element 12, deck 14 and hull 16, described in more detail below, inflatable boat 10 is otherwise conventional and thus further description of the boat per se will be dispensed with.

As shown in FIG. 1, inflatable tube element 12 forms the sidewall of inflatable boat 10. Typically, such an inflatable boat 10 will include two or more inflatable tube elements 12 around a substantial portion of the perimeter of the boat 10 or around the entire perimeter, in some instances.

Figure 2:
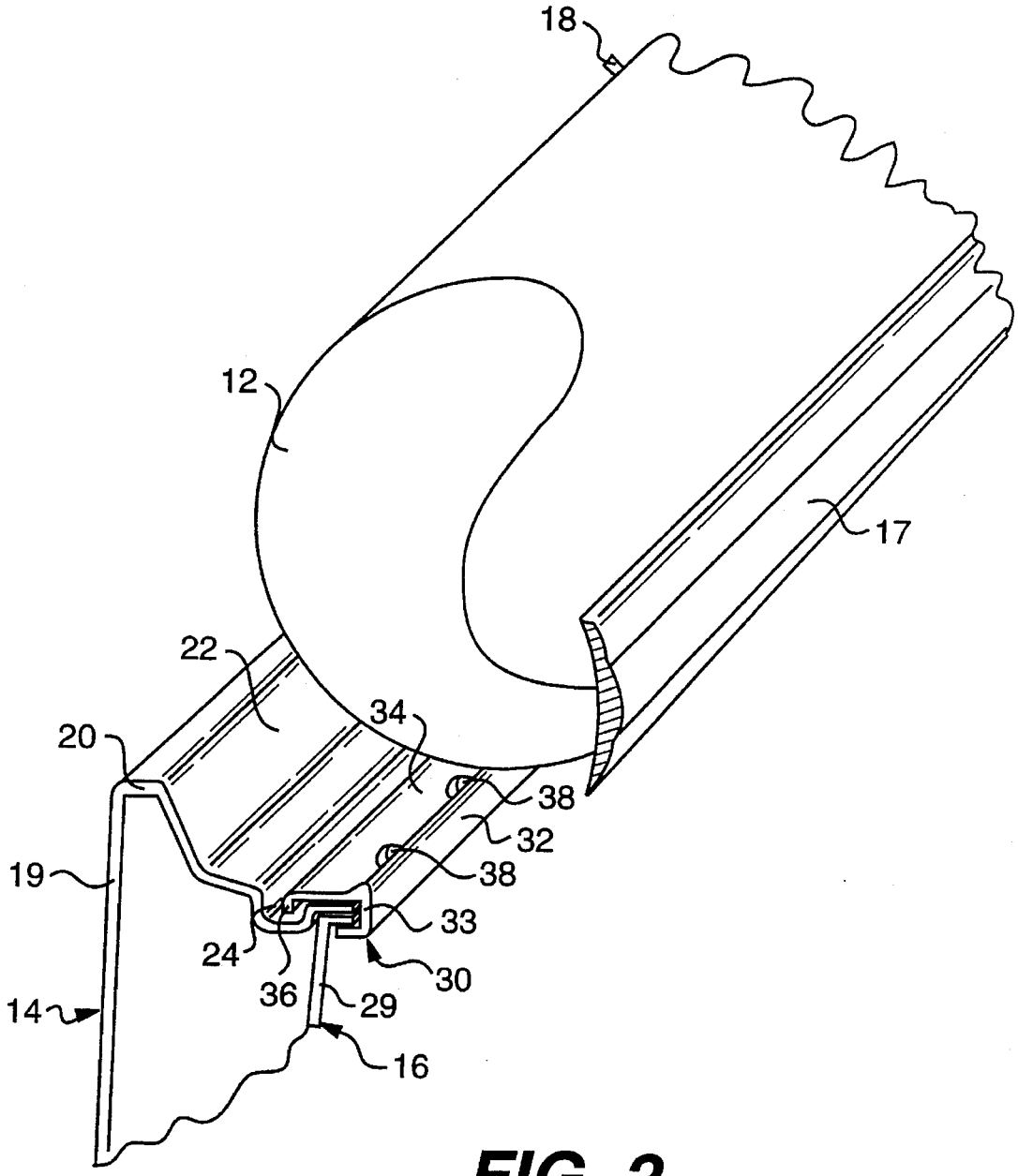
FIG. 2 is a perspective view of a cross-section of the hull/deck joint of the boat with the tube connector member omitted.

In FIG. 2 there is a shown a perspective view of a cross-section of a portion of the deck 14, hull 16 and tube element 12 wherein the tube element 12 is in a partially inflated state. The tube connector member 40 has been omitted from this figure for the sake of clarity.

As illustrated, deck 14 includes an upright support member 19 which extends at least partially around the perimeter of deck 14 of boat 10 and a deck flange 20 which extends generally laterally outwardly from support member 19. Deck flange 20 is preferably formed integrally with support member 19. Deck flange 20 includes a downwardly angled portion forming a tube cradle 22 and terminates in a lower longitudinally recessed portion forming a trough 24. Deck flange 20 serves in affixing deck 14 to hull 16 while at the same time providing support for inflatable tube element 12. In particular, tube cradle 22 supports inflatable tube element 12 when inflatable tube element 12 is fully inflated and positioned along the perimeter of the boat.

As shown, hull 16 includes an upright hull member 29 and a hull flange 33 that extends laterally outwardly from hull member 29 and is positioned adjacent the outward edge of a deck flange 20. Again, hull flange 33 is preferably formed integrally with hull member 29. An attachment member 32 includes a U-shaped portion 30 constructed to fit over the outward edges of deck flange 20 and hull flange 33 as shown in FIG. 2. Attachment member 32 includes an inwardly extending attachment flange 34 which extends far enough to cover at least a portion of trough 24 to thereby perform a function as described below. In the illustrated embodiment, attachment flange 34 of attachment member 32 includes a downwardly extending lip 36 having a function which will be explained in more detail with reference to FIG. 3.

Also shown in FIG. 2 are a plurality of releasable attachment elements 38. Releasable attachment elements 38 which form the attachment means for attaching the deck flange 20 to hull flange 33 can be screws, bolts or other equivalent means. Releasable attachment elements 38 are employed to attach deck flange 20 to hull flange 33 and, in the illustrated embodiment, are also employed to attach attachment member 32 to both deck flange 20 and hull flange 33. A short, removable portion of tube attachment member 32 is provided around the bow. It can be removed from deck flange 20 and hull flange 33 to facilitate removal of inflatable tube element 12 for repair or replacement.

Inflatable tube 12 also includes a valve 18 for inflating and deflating inflatable tube 12. In order to provide some abrasion protection, inflatable tube 12 is provided with a rub strake 17.

Figure 3:
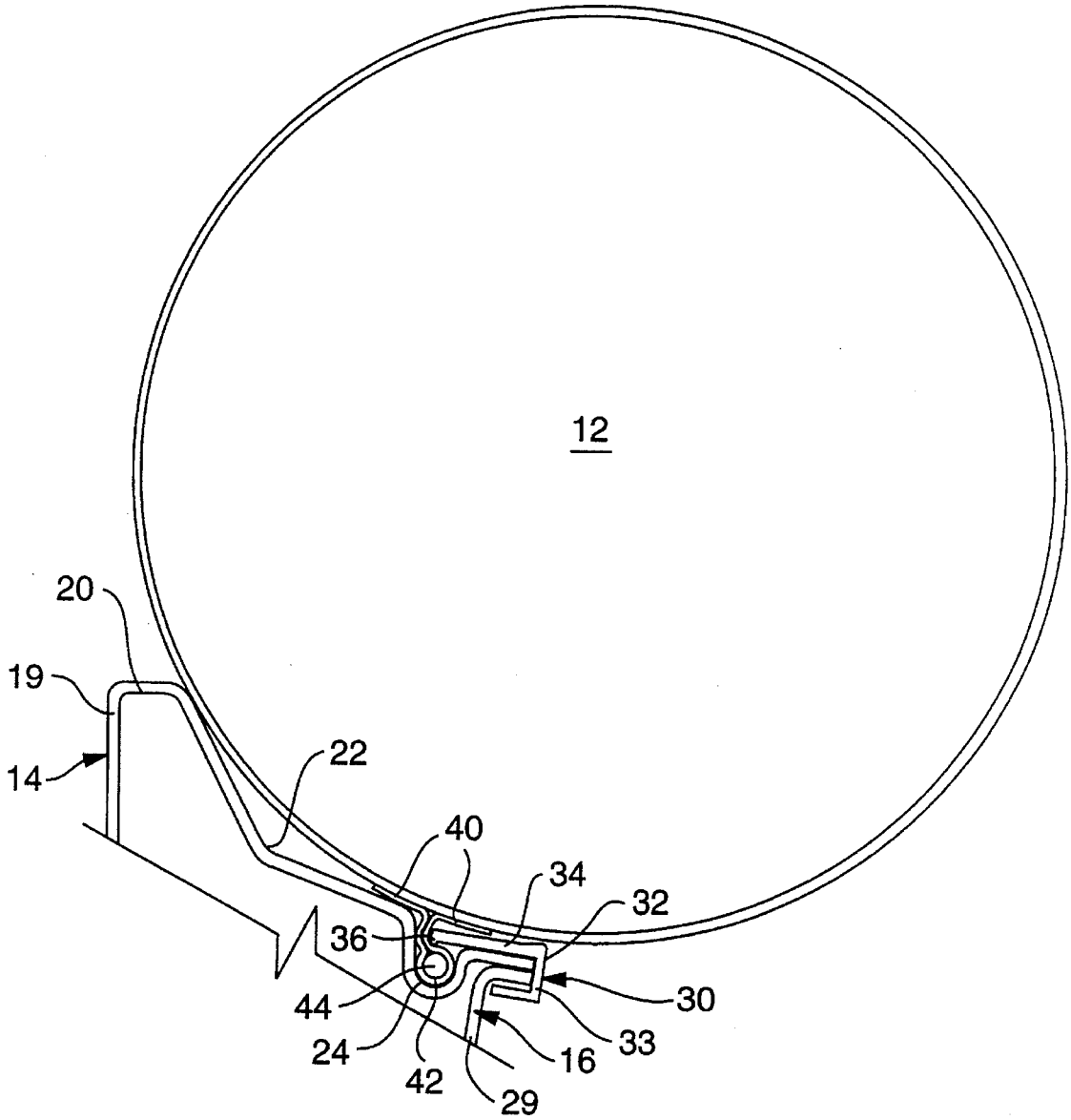
FIG. 3 is a cross-sectional view in an enlarged scale of the tube attachment device of the invention taken generally along line 3—3 of FIG. 1.

Referring now to FIG. 3, an arrangement is shown for attaching inflatable tube element 12 to deck flange 20. In particular, inflatable tube element 12 has a connector element 40 affixed thereto by any suitable means such as adhesive, stitches, etc. Connector element 40 includes a pocket 42 which is formed, for example, by making a loop of connector element 40 and attaching it to itself. Pocket 42 may have a rope 44 positioned therein in order to facilitate placement of connector element 40 in position in trough 24 as well as provide pocket 42 with the required thickness so that it will be retained in trough 24 by the attachment flange 34. As can be seen, pocket 42, including rope 44, is adapted to fit into trough 24 of deck flange 20 when inflatable tube element 12 is positioned on tube cradle 22.

Figure 4:
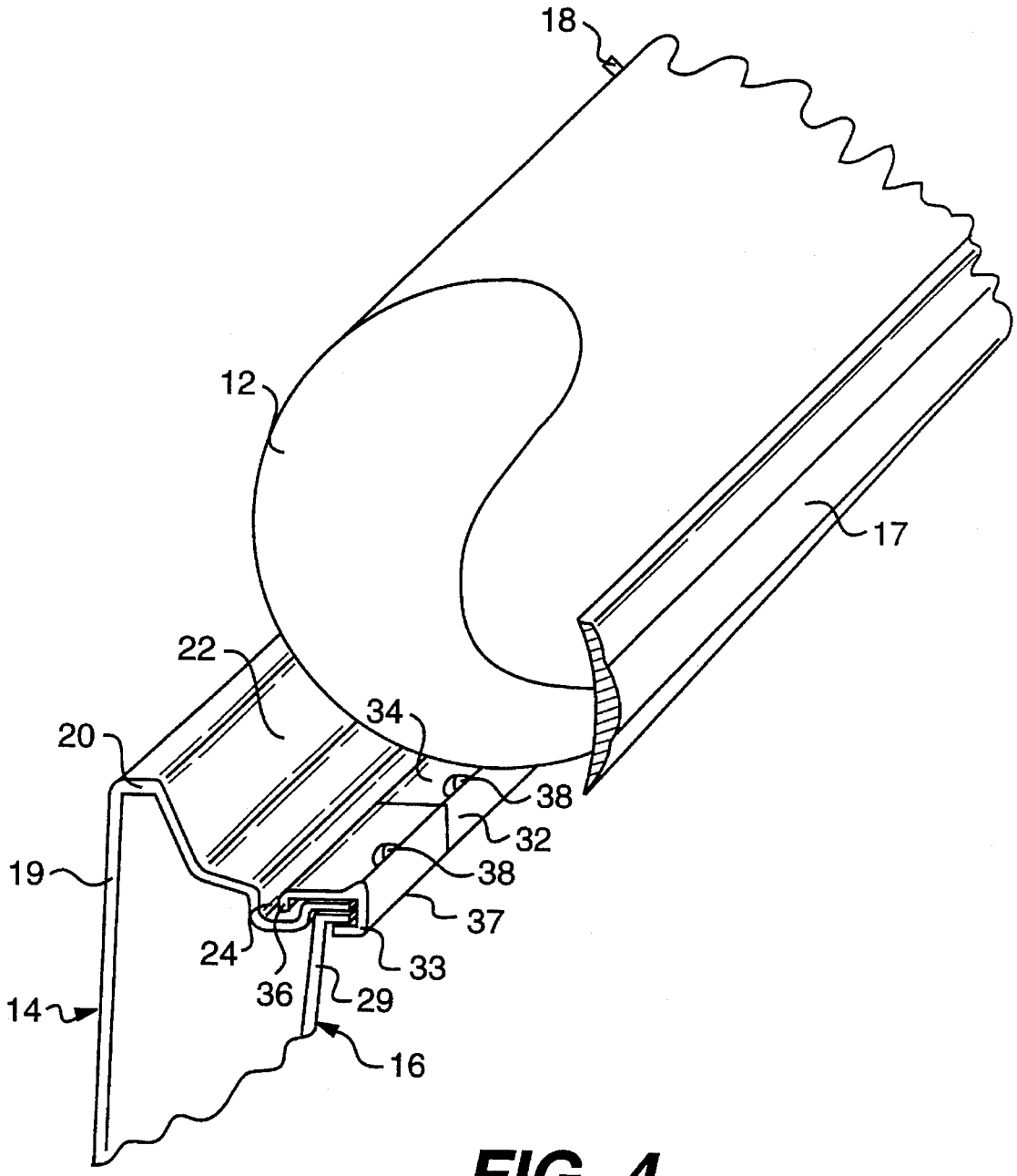
FIG. 4 is a perspective view of a cross-section of the hull/deck join of the boat with the tube connector member omitted and showing a removable section of the attachment member.

As mentioned above, attachment flange 34 extends over at least a portion of the trough 24 in which pocket 42 of connector member 40 is received. Downwardly extending lip 36 abuts against connector member 40 as shown in FIG. 3 in order to securely retain connector member 40 in trough 24. In this manner, inflatable tube element 12 is attached to deck 14 and hull 16. Referring now to FIG. 4 there is shown an alternative embodiment of the present invention which is similar to the embodiment of FIG. 2 except that attachment member 32 includes a removable section 37 which can be removed by removing attachment element 38 such that the inflatable tube 12 can be detached from the deck 14 of the boat.

In operation, in order to attach inflatable tube element 12 to boat 10, inflatable tube element 12 is slid into the slot formed by the trough 24 and attachment member 32 in partially or fully deflated condition so that rope 44 within pocket 42 is received in trough 24. Then, the bow piece of attachment member 32 is put in place as shown in FIG. 3, and inflatable tube element 12 is inflated. It will be noted that a fully inflated inflatable tube element 12 abuts against the upper surface of attachment member 32 thereby providing additional support for inflatable tube element 12 as well as urging lip 36 of attachment member 32 downwardly into abutting relationship with connector member 40. In this manner, a solid support for inflatable tube element 12 is provided as well as a secure attachment between inflatable tube element 12, deck 14 and hull 16.

In a particularly preferred embodiment, a section of the attachment member 32 is removable from deck 14 and hull 16 without removing the entire length of attachment member 32. Once the section, which may preferably be the bow section, of the attachment member 32 is removed, inflatable tube element 12 can be positioned with the end of connector member 40 and pocket 42 in trough 24. Then, inflatable tube element 12 is slid laterally to thereby slide pocket 42 of connector element 40 under the remaining section of attachment member 32 which is still in position on deck 14 and hull 16. The sliding action is facilitated by partially deflated condition of the inflatable tube element 12. Further, rope 44 will give pocket 42 sufficient rigidity so that it can be pushed along in the channel. Once inflatable tube element 12 is in position, the removable section of attachment member 32 is replaced and, if desired, affixed to the decks 14 and hull 16. Lastly, inflatable tube element 12 is inflated.

The foregoing description has been presented for the purposes of illustration and description only and is not intended to limit the scope of the invention in any way. The scope of the invention is to be determined from the claims appended hereto.

What is claimed is:

1. A device for joining an inflatable tube to the hull and the deck of a rigid boat having a perimeter, the boat including a deck, a hull and at least one inflatable tube extending around at least a portion of the perimeter of the boat and forming a sidewall of the boat, said device comprising:

an outwardly extending deck flange attached to the deck of the boat and having an outboard edge, and a trough which is spaced inwardly from the outboard edge, an outwardly extending hull flange attached to the hull of the boat and having an outboard edge, said hull flange being positioned adjacent to said deck flange, a tube connector member attached to the inflatable tube of the boat and including a connector element received in the trough in said deck flange, and an attachment member in engagement with the outboard edges of said deck flange and said hull flange and including an attachment flange extending inwardly over a portion of said trough so as to retain said tube connector element in said trough.

2. A device for joining an inflatable tube to the hull and the deck of a rigid boat as claimed in claim 1 wherein the deck flange and the hull flange are formed integrally with the deck and hull of the boat, respectively.

3. A device for joining an inflatable tube to the hull and the deck of a rigid boat as claimed in claim 2 wherein the deck flange is attached to the hull flange by an attachment means to form a hull/deck join.

4. A device for joining an inflatable tube to the hull and the deck of a rigid boat as claimed in claim 3 wherein the deck flange further comprises a tube cradle for supporting the inflatable tube which is located adjacent to the trough.

5. A device for joining an inflatable tube to the hull and the deck of a rigid boat as claimed in claim 4 wherein the attachment member further comprises a lip located at an end of the attachment flange, said lip being adapted to abut with said tube connector element in order to secure said tube connector element in the trough.

6. A device for joining an inflatable tube to the hull and the deck of a rigid boat as claimed in claim 4 wherein the attachment member fits over the outboard edges of the deck and hull flanges to provide additional support to the hull/deck join.

7. A device for joining an inflatable tube to the hull and the deck of a rigid boat as claimed in claim 6 wherein the attachment member extends around at least a portion of the perimeter of the boat and at least a section of the attachment member at an end thereof is removable to permit detachment of the inflatable tube from the deck of the boat.

8. A device for joining an inflatable tube to the hull and the deck of a rigid boat as claimed in claim 1 wherein the attachment member is affixed to the deck flange and the hull flange by a releasable attachment means.

9. An inflatable boat comprising a perimeter, a deck, a hull and at least one inflatable tube extending around at least a portion of the perimeter of the boat to form a sidewall of the boat, an outwardly extending deck flange attached to the deck of the boat and having an outboard edge and a trough which is spaced inwardly from the outboard edge, an outwardly extending hull flange attached to the hull of the boat and having an outboard edge, said hull flange being positioned adjacent to said deck flange, a tube connector member attached to the inflatable tube of the boat and including a connector element received in the trough in said deck flange, and an attachment member in engagement with the outboard edges of said deck flange and said hull flange and including an attachment flange extending inwardly over a portion of said trough so as to retain said tube connector element in said trough.

10. An inflatable boat as claimed in claim 9 wherein the deck flange and the hull flange are formed integrally with the deck and hull of the boat, respectively.

11. An inflatable boat as claimed in claim 10 wherein the deck flange is attached to the hull flange by an attachment means to form a hull/deck join.

12. An inflatable boat as claimed in claim 11 wherein the deck flange further includes a tube cradle for supporting the inflatable tube.

13. An inflatable boat as claimed in claim 12 wherein the attachment member further comprises a lip located at an end of the attachment flange, said lip being adapted to engage with said tube connector element in order to secure said tube connector element in place in the trough.

14. An inflatable boat as claimed in claim 11 wherein the attachment member fits over the outboard edges of the deck and hull flanges to provide additional support to the hull/deck join.

15. An inflatable boat as claimed in claim 11 wherein the attachment member extends around at least a portion of the perimeter of the boat and at least a section of the attachment member at an end thereof is removable to permit detachment of the inflatable tube from the deck of the boat.

16. An inflatable boat as claimed in claim 15 wherein the bow section of the attachment member is removable to permit detachment of the inflatable tube from the deck of the boat.

17. An inflatable boat as claimed in claim 9 wherein the attachment member is affixed to the deck flange and the hull flange by a releasable attachment means.

18. A method of attaching an inflatable tube to the deck and hull of a rigid boat wherein the deck and hull are each provided with respective outwardly extending deck and hull flanges positioned adjacent to one another, the inflatable tube having a tube connector member which includes a tube connector element, the deck flange including a trough for receiving the tube connector element, and the boat being provided with an attachment member which fits over the deck and hull flanges and the trough to retain the tube connector element in the trough said method comprising the steps of:

inserting the tube connector element in the trough of the deck flange with the inflatable tube positioned on the deck of the boat in at least partially deflated condition, positioning at least a section of the attachment member over the deck and hull flanges such that it extends over the trough in the deck flange, and inflating the inflatable tube to a fully inflated condition.

19. A method in accordance with claim 18 wherein the attachment member extends at least partially around the perimeter of the boat and an end section of the attachment member is removable from the boat further comprising the initial step of removing the removable end section of the attachment member from the boat.

20. A method in accordance with claim 19 wherein said inserting step comprises sliding the tube connector member into the trough from the end of the trough from which the removable end section of the attachment member has been removed.

* * * * *